US009186571B2

(12) United States Patent
Daudey et al.

(10) Patent No.: US 9,186,571 B2
(45) Date of Patent: Nov. 17, 2015

(54) IN-LINE ROLLER SKATE

(71) Applicants: Maria Daudey, Sint Oedenrode (NL); Simone Charlotte Heukers, Hoogezand-Sappemeer (NL)

(72) Inventors: Maria Daudey, Sint Oedenrode (NL); Simone Charlotte Heukers, Hoogezand-Sappemeer (NL)

(73) Assignee: Hendrik Heukers, Hoogezand-Sappemeer (NL)

( * ) Notice: Subject to any disclaimer, the term of this patent is extended or adjusted under 35 U.S.C. 154(b) by 0 days.

(21) Appl. No.: 14/312,535

(22) Filed: Jun. 23, 2014

(65) Prior Publication Data

US 2014/0367932 A1 Dec. 18, 2014

Related U.S. Application Data

(63) Continuation-in-part of application No. 13/850,700, filed on Mar. 26, 2013, now abandoned, which is a continuation of application No. PCT/NL2011/050645, filed on Sep. 23, 2011.

(30) Foreign Application Priority Data

Sep. 27, 2010 (NL) ..... 2005408
Dec. 15, 2010 (NL) ..... 2005860

(51) Int. Cl.
*A63C 17/14* (2006.01)
*A63C 17/06* (2006.01)

(52) U.S. Cl.
CPC ..... *A63C 17/1409* (2013.01); *A63C 17/062* (2013.01); *A63C 17/1418* (2013.01)

(58) Field of Classification Search
CPC .. A63C 17/004; A63C 17/061; A63C 17/062; A63C 17/1409; A63C 17/1418; A63C 17/1427
USPC ..... 280/11.204, 11.206, 11.207, 11.211, 280/11.214, 11.215, 11.217
See application file for complete search history.

(56) References Cited

U.S. PATENT DOCUMENTS

| | | | | |
|---|---|---|---|---|
| 2,552,987 | A * | 5/1951 | Loertz, Jr. | 280/11.28 |
| 5,088,748 | A | 2/1992 | Koselka et al. | |
| 5,135,244 | A * | 8/1992 | Allison | 280/11.28 |
| 5,413,362 | A | 5/1995 | De Santis | |
| 5,478,094 | A | 12/1995 | Pennestri | |
| 5,486,011 | A * | 1/1996 | Nelson | 280/11.207 |
| 5,501,474 | A * | 3/1996 | Conte | 280/11.215 |
| 5,639,104 | A * | 6/1997 | Haldemann | 280/11.207 |
| 5,791,663 | A | 8/1998 | Klukas | |
| 5,927,728 | A | 7/1999 | Gignoux et al. | |

(Continued)

FOREIGN PATENT DOCUMENTS

| | | |
|---|---|---|
| DE | 200 10 244 | 9/2000 |
| DE | 199 58 597 | 6/2001 |
| EP | 0 795 348 | 2/1997 |

*Primary Examiner* — Frank Vanaman
(74) *Attorney, Agent, or Firm* — Eric Karich; Karich & Associates

(57) ABSTRACT

An in-line roller skate has a boot for accommodating a person's foot, a frame connected to the boot, and at least two wheels connected to the frame at a mutual distance in the skating direction for rideable support of the boot. The frame has a first frame portion and a second frame portion, wherein at least one wheel is connected to each frame portion and wherein the first frame portion and the second frame portion are mutually movable between a riding position and a braking position.

16 Claims, 5 Drawing Sheets

(56) References Cited * cited by examiner

U.S. PATENT DOCUMENTS 6,217,038 B1 * 4/2001 Moe ..... 280/11.207
6,279,921 B2 8/2001 Bozinovic

IN-LINE ROLLER SKATE

CROSS-REFERENCE TO RELATED APPLICATIONS

This application for a utility patent is a continuation-in-part of a previously filed utility patent, still pending, having the application Ser. No. 13/850,700, filed Mar. 26, 2013, which is a continuation of a previously filed PCT application, now abandoned, having the application number PCT/NL2011/050645, filed 23 Sep. 2011. This application also claims the benefit of Netherlands applications NL 2005408, filed 27 Sep. 2010, and NL 2005860, filed 15 Dec. 2010.

BACKGROUND OF THE INVENTION

1. Field of the Invention

The invention relates to an in-line roller skate.

2. Description of the Related Art

A known in-line roller skate customarily comprises a boot for accommodating a person's foot, a frame connected to the boot, and at least two wheels connected to the frame and having a mutual distance and intended for supporting the boot in skating action. A user, such as a sportsman, can skate with a pair of these in-line roller skates on a track such as a road surface. It may be desired to brake while the in-line roller skates are being used, for example because one comes near a road junction or because other road users are a hindrance to the free use of the road. Therefore, it is known that this in-line roller skate is equipped with brakes. A known brake comprises a brake pad linked to the boot, where the brake pad is forced against the track by tipping the tip of the boot upward. The track then exerts a braking force on the brake pad in a direction opposite to the skating direction and thus on the boot and thus on the user of the in-line roller skate. Not only is such a brake pad esthetically undesired, because of its customarily large size, but it also renders the in-line roller skate unstable during the braking operation, because the in-line roller skate is supported by only one wheel during the braking operation. This may lead to hazardous situations.

One embodiment of a prior art in-line roller skate described in EP 0 795 348 A1. The mounting bracket portion of this skate is movable relative to the boot and is connected by means of an axle to a mounting bracket portion fixedly attached to the boot. The axle is formed by a pin whose ends are slidable in slots which are provided in the two portions of the mounting bracket. The brake member in this known in-line roller skate is formed by two conical discs which are present on the pin. The slots are positioned at an angle relative to each other so that, when portions of the mounting bracket are turned relative to each other during the braking operation, the pin slides relative to the two portions and so doing pushes the conical discs against one or two of the wheels connected to the movable portion.

While this construction is advantageous compared to the state of the art described hereinbefore, this construction has disadvantages. For example, during the braking operation the wheels may get stuck between the conical discs. In addition, this construction is relatively complex. The two conical discs are connected to each other by means of an elastic intermediate member and slots are to be provided in the portions of the mounting bracket. In addition, the conical discs can be removed from the mounting bracket, be it with some difficulty, after which the in-line roller skate can be used for skating again. This is something young people like to do, but which is not a safe way.

SUMMARY OF THE INVENTION

It is an object of the present invention to provide an in-line roller skate of the type defined in the opening paragraph, which is safe to use and nevertheless simple. For this purpose the in-line roller skate according to the invention is characterised in that the brake member is fitted over the second wheel of the in-line roller skate. Preferably, the brake member has a smooth brake surface. The brake member is for example a metal plate. Since during the braking operation the brake member is pressed against the rear wheel, this wheel cannot block but it always remains possible for slip to occur between the brake member and the wheel. Further it is impossible to remove portions of the brake construction and no longer exert a braking force. Since the brake member may be configured as a simple brake pad or plate and the position of the axle between the two portions of the mounting bracket is fixed, the construction of the in-line roller skate according to the invention is very simple indeed. For example, the mounting bracket is formed by (a portion of) a frame, or it may comprise (a portion of) a frame. In the following the terms mounting bracket and frame are used one for the other.

Basically, the in-line roller skate according to the invention can be manufactured in various ways. For example, the second wheel may be located at a fixed position relative to the boot, while a movable portion of the mounting bracket includes a brake pad, but, preferably, the wheel is movably connected to the boot and the brake pad is fixedly connected to the boot. Preferably, the brake member forms part of or is attached to a sole or a heel of the boot. The first wheel may be located in the vicinity of the tip of the boot and may be connected, for example, to the non-movable portion of the mounting bracket. The movable portion of the mounting bracket may further include a plurality of wheels, for example depending on the weight to be carried by the in-line roller skate.

An additional advantage is that no relatively large brake pad is needed, so that the design of the in-line roller skate may be more compact and more attractive esthetically. Showy brake pads are further regarded as unprofessional mostly by young users who see them as a reason for removing them. As a result, the in-line roller skates become unbraked and thus hazardous, a disadvantage also outweighed by the present invention.

In a braking position the member increasing the resistance of friction exerts a force on the second wheel in a direction opposite to the skating direction. Thus, a user can easily generate a force increasing the resistance of friction as a result of a variation of the orientation of the boot.

The member increasing the resistance of friction may be embodied in various ways. For example, the member increasing the resistance of friction may comprise a brake pad where hydraulic pressure in a brake line is increased in that the first and second frame portions are mutually displaced and the brake pad is forced against a brake disc of at least one wheel. In a simple embodiment the member increasing the resistance of friction comprises a brake pad connected to the first frame portion, where in the braking position the at least one wheel connected to the second frame portion pushes against the brake pad. This is simple from a construction engineering point of view. Although the brake pad and/or the wheel will then wear down during use, these component parts are easy to replace. A user may also verify in a simple manner to what extent the brake pad and/or wheel have worn down. In an embodiment a braked wheel comprises a sturdier durable synthetic material so that fast wearing down is counteracted.

The (brake) member increasing the resistance of friction may be fitted for example over a rear wheel of the in-line roller skate, for example in one of the portions of the mounting bracket. Both these measures individually lead to the fact that no obstruction is experienced from a brake extending outside the regular contour of the in-line roller skate, both from a point of view of safety and esthetics. The member increasing the resistance of friction may also form part of the sole of the boot.

In one embodiment the first and second frame portions can mutually rotate around a frame shaft extending in essence transverse to the skating direction. This is not just simple from a construction point of view, but a user can also mutually rotate the first and second frame portions and thus obtain a braking effect by merely tipping the boot. A tipping of this kind is experienced as a natural braking movement.

To this end the movable portion of the mounting bracket may be rotary relative to a mounting bracket portion rigidly connected to the boot, where the two mounting bracket portions are mutually coupled by means of a guide.

The coupling to the guide may be located for example between the centre of rotation of the mounting bracket portions and a front side of the in-line roller skate and consist of a slot for a pin to be guided in it, which pin may be formed for example by an axle.

The frame axis may have various locations. The frame axis may extend for example in a projected plane of the shaft of the boot. It turns out that such a location of the frame axis enables a user to tip the boot by shifting the body weight in a direction opposite to the skating direction, without there being a risk of an undesired tipping of the boot or a risk of the user having to apply a relatively large force and/or shift of the body weight.

In another embodiment the frame axis can be shifted in the skating direction. This increases the flexibility of the in-line roller skate. For example, by shifting the frame axis more to the front, that is to say, in the skating direction, by means of a slight shift of the bodyweight, a user can cause a tipping of the boot and thus a mutual displacement of the first and second frame portions. This may be advantageous to a beginning user of the in-line roller skate in that a braking force is obtained by a slight shift of the bodyweight. A more advanced user can shift the frame axis more to the rear, that is to say, in a direction opposite to the skating direction. This requires a relatively large shift of the user's bodyweight for a desired tipping of the boot. Although such a relatively large shift of the user's bodyweight may be annoying, the risk of an undesired braking force, for example caused by the user's temporarily stretching out and thus shifting his bodyweight to the rear, is minimized. In the case of a shiftable axis, a locking device may be provided for detachably fitting the shaft at a desired position. A device of this kind may be designed in a very simple embodiment as is customary in for example water pump pliers.

In again another embodiment the wheel shaft of the at least one wheel connected to the second frame portion is located behind the frame axis seen in the skating direction. By lifting the tip of the boot, the wheel connected to the second frame portion and the brake pad are then moved towards each other.

In yet another embodiment two, three or four wheels are connected at mutual distances to the frame seen in the skating direction. Such a number of wheels enhances the in-line roller skate's stability during the braking operation, whereas the length of the second frame portion remains limited. Although the number of wheels of the first frame portion may vary as well, preferably the number of wheels connected to the first frame portion is limited to one or two wheels.

In an advantageous embodiment the sides of the wheels turned away from the boot extend substantially in one plane. This measure not only enhances the stability during use of the in-line roller skate, but also causes the wear of the wheels to be reduced.

In still another embodiment the frame is arranged for avoiding a force being exerted by the boot on at least one wheel in a direction opposite to the skating direction. Since the first frame portion and the second frame portion can be shifted mutually, there is a risk of at least one wheel making undesired contact with a portion of the frame and/or the boot, as a result of which a force increasing the resistance of friction may be exerted on that wheel. This is an undesired effect. In one embodiment the frame comprises a stop for reducing the mutual shift of the first and the second frame portion. This is a simple and strong solution from a construction engineering point of view.

The invention further provides a frame for carrying the wheels of an in-line roller skate according to the present invention, comprising a first and a second frame portion, in which at least one wheel can be connected to each frame portion and in which the first and the second frame portions can be mutually shifted between a riding position, in which the wheels are running clear in essence, and a braking position in which a member increasing the resistance of friction exerts a force on at least one wheel in a direction opposite to the skating direction. For advantages of the frame according to the invention the reader be referred to the advantages of the in-line roller skate according to the invention. A frame of this type may be used for both new and existing in-line roller skates.

Although it is not excluded for the member increasing the resistance of friction to be part of the boot of the in-line roller skate, in one embodiment the frame is equipped with the member increasing the resistance of friction, such as a brake pad.

A construction that has turned out to be simple and robust may be obtained when the movable mounting bracket portion, at any rate in the riding position, is enclosed by the portion rigidly attached to the boot. In this way the sideways load is increased. In a simple embodiment of this the two mounting bracket portions comprise in essence U-profiles that can be put together.

BRIEF DESCRIPTION OF THE DRAWINGS

The invention will now be described in more detail based on examples of embodiment while reference is made to the appended drawing figures. In the drawing figures like parts are identified with like reference numerals, in which.

DETAILED DESCRIPTION OF THE DRAWINGS

Figure 1:
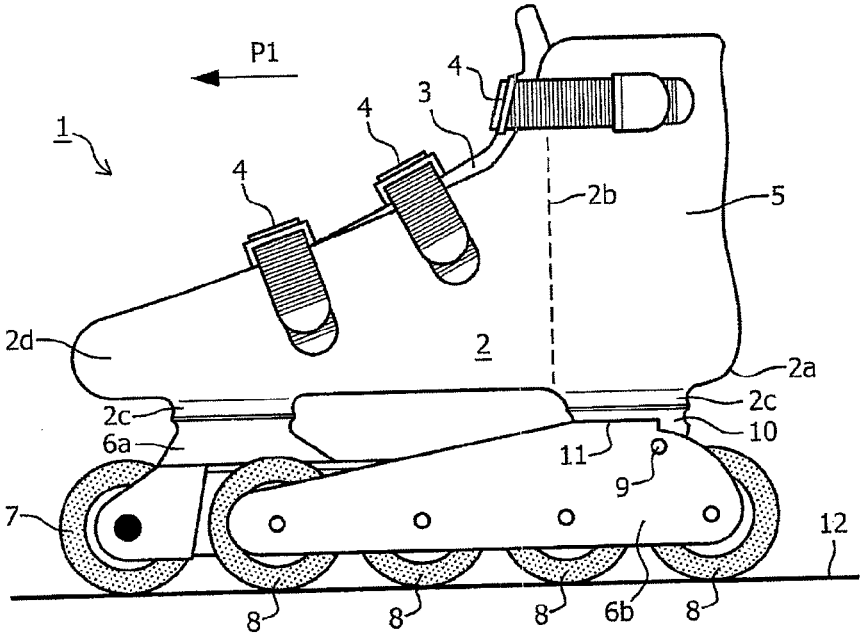
FIG. 1 shows a side view of an in-line roller skate according to the invention, where the first and second frame portions are shown in a riding position.
Figure 2:
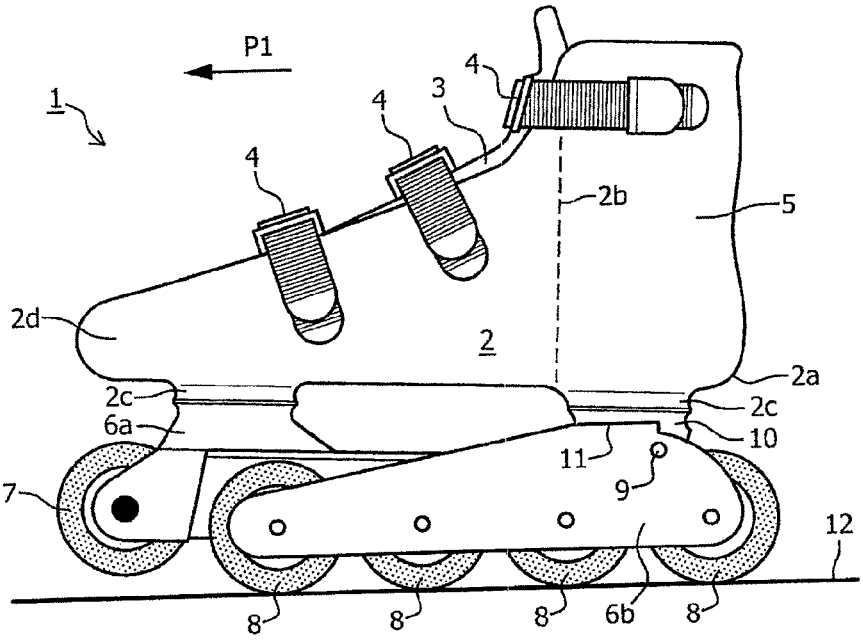
FIG. 2 shows a side view of an in-line roller skate according to the invention, where the first and second frame portions are shown in a braking position.

With reference to FIGS. 1 and 2, an in-line roller skate referred to as 1 is shown. The in-line roller skate comprises a boot 2 for accommodating a person's foot. The boot comprises a lip 3 assumed to be known and fastening means 4 arranged as buckles. The boot 2 comprises a shaft 5 ending at the heel 2*a* of the boot, which shaft is defined by the heel of the boot and the broken line 2*b*. A frame 6 is connected to a synthetic sole 2*c* of the boot 2. The frame 6 comprises a first frame portion 6*a* which is rigidly connected to the sole 2*c* near the tip 2*d* of the boot 2. The frame 6 also comprises a second frame portion 6*b* which is rigidly connected to the sole 2*c* near the heel 2*a* of the boot 2. To the first frame portion 6*a* is connected a wheel 7. To the second frame portion 6*b* are connected, in the skating direction and in line with the arrow P, wheels 8 at mutual distances. All wheels 7, 8 support the boot 2 on a foundation 12 in the embodiment shown here. The first frame portion 6*a* and the second frame portion 6*b* are mutually rotatable around a frame axis 9. The frame axis 9 extends in a projected plane of the shaft 5 of the boot 2. The second frame portion 6*b* is connected to the boot 2 via a brake pad 10 made from a synthetic material.

In one embodiment, the connection between the second frame portion 6*b* and the boot 2 is only at the brake pad 10, more particularly, only at the location of the frame axis 9 which goes through the brake pad 10. If one removes the brake pad 10, there is no physical connection between the second frame portion 6*b* and the boot 2. Removal of the brake pad 10 would cause the skate 1 to cease functioning as a skate 1, and also eliminate any braking functionality from the skate 1.

Furthermore, the second frame portion 6*b* comprises a part shaped as a flat surface 11 of the stop of the second frame portion 6*b* for limiting the mutual displacement of the first frame portion 6*a* and the second frame portion 6*b*. This reduces the risk of the front wheel 8 of the second frame portion 6*b*, seen in the skating direction, pushing against the first frame portion 6*a* and/or against the sole 2*c* of the boot 2.

With reference to FIG. 2 the in-line roller skate is shown as represented in FIG. 1, where the first frame portion 6*a* and the second frame portion 6*b* are depicted in a braking position. The tip 2*d* of the boot 2 is tipped upward in this case. The wheel 7 connected to the first frame portion 6*a* then comes free from the ground 12. The four wheels 8 support the boot 2 on the ground 12. The brake pad 10 and the wheel 8 located on the side of the frame shaft 9 opposite to the skating direction $P_1$ are then forced against each other. The brake pad 10 then exerts a force increasing the resistance of friction on the wheel 8 located on the side of the frame shaft 9 opposite to the skating direction $P_1$. As a result, the in-line roller skate will be braked.

Figure 3:
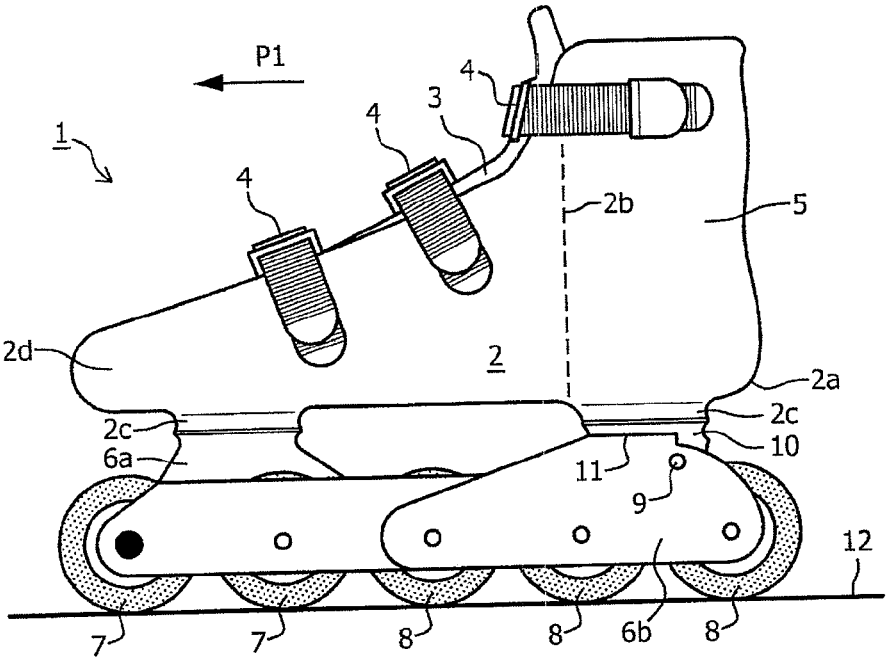
FIG. 3 shows a side view of an embodiment of the in-line roller skate as shown in FIG. 1, where the first and second frame portions are shown in a riding position.

With reference to FIG. 3 an embodiment is shown of the in-line roller skate 1 as shown in FIG. 1, where the first frame portion 6*a* and the second frame portion 6*b* are located in a skating position. In the embodiment shown here two wheels 7 are connected to the first frame portion 6*a* and three wheels 8 are connected to the second frame portion 6*b*. The operation of the in-line roller skate is equal to that of the in-line roller skate shown with reference to FIGS. 1 and 2, where both wheels 7 extend above the ground 12 while the frame portions 6*a* and 6*b* are in a braking position. The second frame portion 6*b* is rotatable relative to the boot 2 between a riding position, in which the at least one second wheel 8 is not in contact with the brake member 10, and a braking position, in which the at least one second wheel 8 is in contact with the brake member 10.

Figure 4:
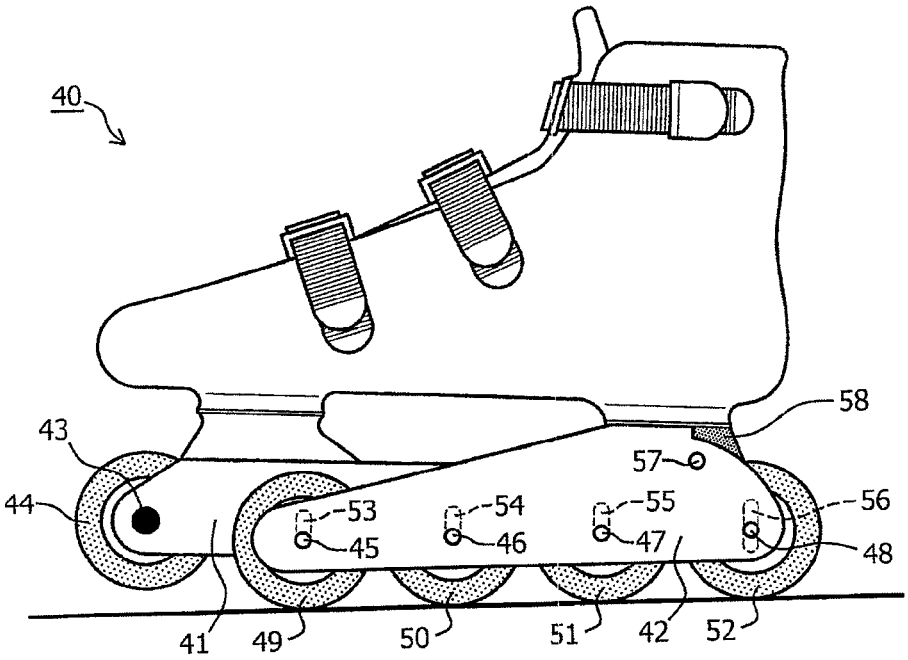
FIG. 4 shows a side view of an in-line roller skate according to the invention, where the first and second frame portions are shown in a braking position.

With reference to FIG. 4 an alternative embodiment of the in-line roller skate according to the present invention is shown. The in-line roller skate 40 comprises a boot equipped with a first wheel 44 that has an axle 43 located at a fixed position relative to the boot. In the embodiment shown the axle 43 is connected to a part of the mounting bracket 41 rigidly connected to the boot. The in-line roller skate further includes a movable mounting bracket portion 42 connected to the boot for the respective shafts 45, 46, 47, 48 of the wheels 49, 50, 51, 52, where at least a portion 42 of the mounting bracket is movable relative to the boot by means of rotation around shaft 57, movable between at least a riding position (not shown) in which the at least second wheel 52 runs clear in essence, and a braking position (shown) in which the at least second wheel 52 is in contact with the brake member 58.

The two mounting brackets 41 and 42 are mutually coupled by means of a plurality of guides 53, 54, 55, 56. The guides comprise a slot in the frame portion 41 through which pins glide which are formed by the wheel shafts 45, 46, 47, 48. In this manner the frame portions 41 and 42 are connected to each other and capable of offering resistance to sideways forces that occur during in-line roller skating. In addition to the configuration shown in FIG. 4 it is equally possible for the movable portion 42 of the mounting bracket to be attached to the inside of the mounting bracket portion 41 rigidly attached to the boot.

Figure 5:
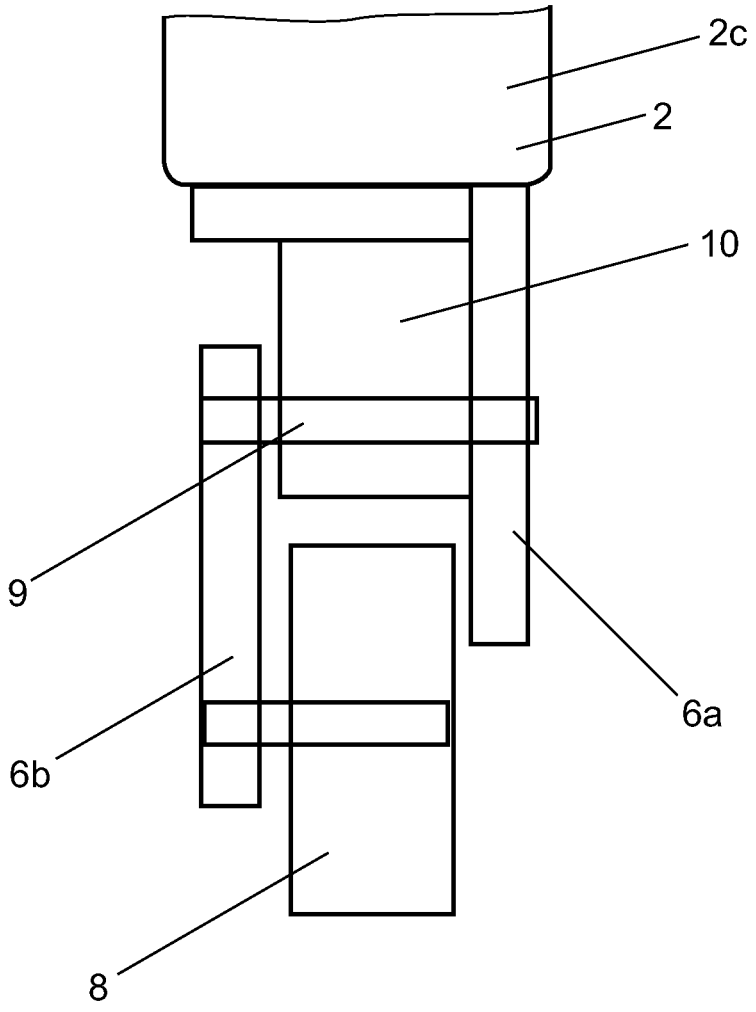
FIG. 5 shows a rear view of an embodiment of the in-line roller skate as shown in FIG. 1, where a second frame portion is rotatably connected to a first frame portion at a brake member.

With reference to FIG. 5, the figure shows a rear view of an embodiment of the in-line roller skate as shown in FIG. 1, where the second frame portion 6*b* is rotatably connected to the first frame portion 6*a* at the brake member 10.

Figure 6:
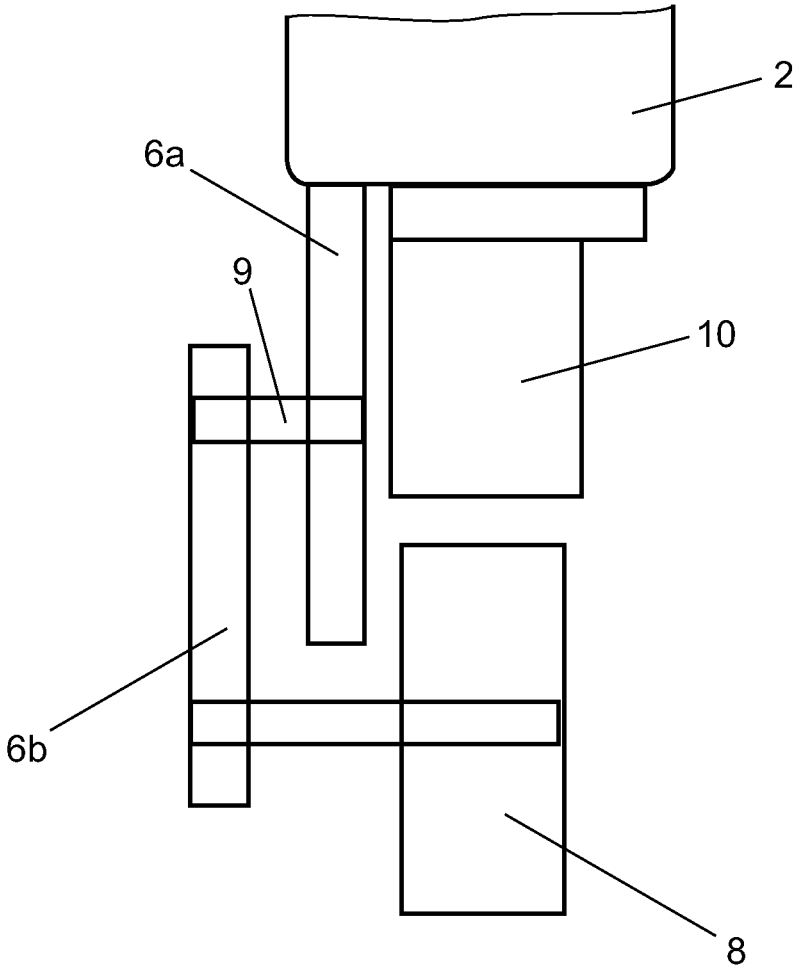
FIG. 6 shows a rear view of an embodiment of the in-line roller skate as shown in FIG. 1, where the second frame portion is rotatably connected to the first frame portion at a frame axis.

With reference to FIG. 6, the figure shows a rear view of an embodiment of the in-line roller skate as shown in FIG. 1, where the second frame portion 6*b* is rotatably connected to the first frame portion 6*a* at the frame axis 9.

Figure 7:
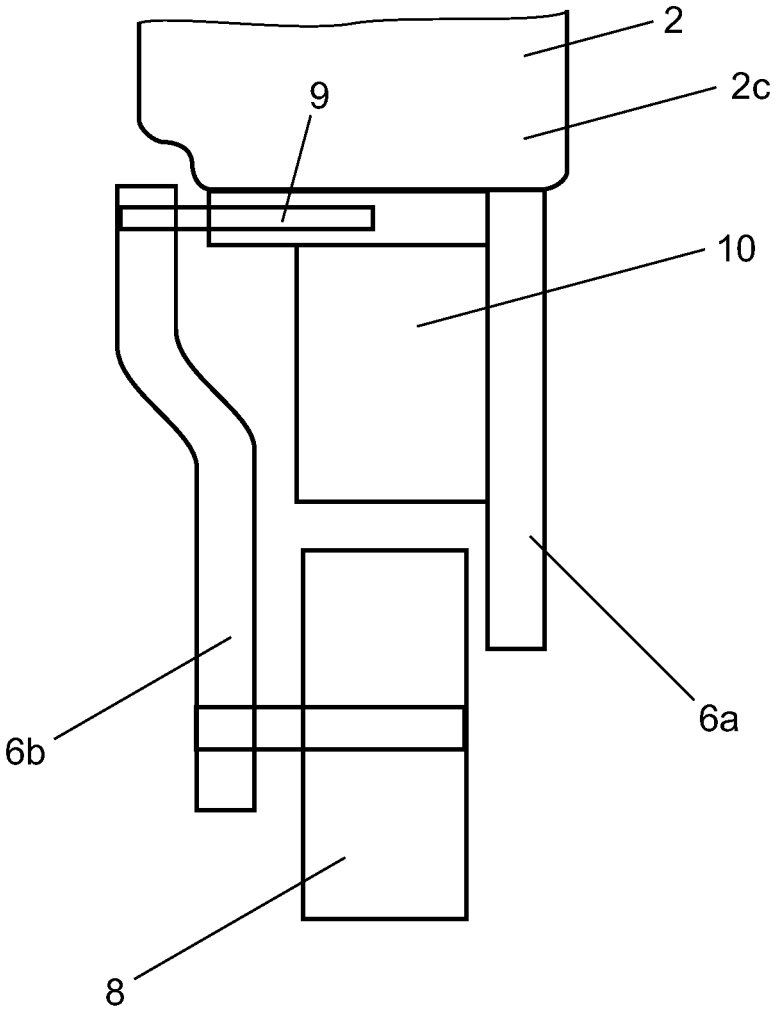
FIG. 7 shows a rear view of an embodiment of the in-line roller skate as shown in FIG. 1, where the second frame portion is rotatably connected to the boot at a frame axis.

With reference to FIG. 7, the figure shows a rear view of an embodiment of the in-line roller skate as shown in FIG. 1, where the second frame portion 6*b* is rotatably connected to the boot 2 at the frame axis 9.

It may be apparent that the invention is not limited to the embodiments depicted and described in this context, but that within the framework of the appended claims a great many variants are possible which will be obvious to the expert in this field.

What is claimed is:

1. An in-line roller skate, comprising:

a boot;

a frame connected to the boot having a first frame portion rigidly connected to the boot, and a second frame portion movable relative to the boot;

a frame shaft rotatably coupling the second frame portion to the first frame portion, and extending transverse in a skating direction;

at least one first wheel on the first frame portion located at a fixed position relative to the boot;

a front second wheel connected to the second frame portion, and located in the skating direction in front of the frame shaft;

a rear second wheel connected to the second frame portion, and located in the skating direction behind the frame shaft;

a brake member connected to at least one of the boot and the first frame portion, or to both the boot and the first frame portion;

wherein the second frame portion is rotatable relative to the boot between a riding position, in which the rear second wheel is substantially free to rotate, and a braking position, in which the rear second wheel is in contact with the brake member to cause the brake member to exert friction on the rear second wheel;

wherein the brake member is fitted in a fixed position above the rear second wheel, and wherein a stop of the frame limits further movement of the second frame portion in respect of the first frame portion in the riding position to avoid the front second wheel connected to the movable second frame portion coming into contact with the boot or the first frame portion.

2. The in-line roller skate of claim 1, wherein the brake member forms part of or is attached to a sole or a heel of the boot.

3. The in-line roller skate of claim 2, wherein the brake member forms part of the heel of the boot.

4. The in-line roller skate of claim 2, wherein the brake member has a smooth braking surface.

5. The in-line roller skate of claim 4, wherein the brake member forms part of the heel of the boot.

6. The in-line roller skate of claim 4, wherein the brake member is configured as a metal plate.

7. The in-line roller skate of claim 6, wherein the brake member forms part of the heel of the boot.

8. The in-line roller skate of claim 1, wherein the brake member is incorporated into the first frame portion.

9. The in-line roller skate of claim 1, wherein the first frame portion and the second frame portion are mutually coupled by means of a guide.

10. The in-line roller skate of claim 9, wherein the coupling to the guide is located between the frame shaft and a front of the in-line roller skate.

11. The in-line roller skate of claim 9, wherein the coupling comprises a slot for guiding a pin therein.

12. The in-line roller skate of claim 1, wherein the second frame portion is enclosed by the first frame portion.

13. The in-line roller skate of claim 12, wherein the first frame portion and the second frame portion comprise U-profiles that can be put together.

14. The in-line roller skate of claim 1, wherein the stop comprises a part shaped as a flat surface on the second frame portion.

15. The in-line roller skate of claim 1, wherein the at least one first wheel is located in a vicinity of a tip of the boot.

16. The in-line roller skate of claim 1, wherein the rear second wheel is provided in a sturdy, durable synthetic material to counteract wear.

* * * * *